US007386917B2

(12) United States Patent
Gogel et al.

(10) Patent No.: US 7,386,917 B2
(45) Date of Patent: Jun. 17, 2008

(54) VACUUM CLEANER WITH QUICK RELEASE WAND

(75) Inventors: Nathan A. Gogel, Hustonville, KY (US); Donald E. Proffitt, Richmond, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 60 days.

(21) Appl. No.: 11/495,797

(22) Filed: Jul. 28, 2006

(65) Prior Publication Data

US 2008/0022489 A1 Jan. 31, 2008

(51) Int. Cl.
*A47L 9/02* (2006.01)
*A47L 9/24* (2006.01)

(52) U.S. Cl. ..... 15/414; 285/7

(58) Field of Classification Search ..... 15/414, 15/415.1; 285/7, 277, 320
See application file for complete search history.

(56) References Cited

U.S. PATENT DOCUMENTS 2,245,151 A 6/1941 Martinet
2,579,314 A 12/1951 Grumblatt
2,582,446 A 1/1952 Martinet
2,727,762 A 12/1955 Ziegler, Jr.
3,351,363 A 11/1967 Downey et al.
4,114,927 A 9/1978 Butcher
4,494,270 A 1/1985 Ritzau et al.
4,700,429 A 10/1987 Martin et al.
4,758,023 A 7/1988 Vermillion
5,685,044 A * 11/1997 Lavis et al. ..... 15/415.1
5,836,620 A 11/1998 Wang et al.
5,941,575 A 8/1999 Herbst
5,954,370 A 9/1999 Pietersen
5,967,563 A * 10/1999 Lavis et al. ..... 285/7
6,474,696 B1 11/2002 Canale
6,494,492 B1 12/2002 Ha
6,519,810 B2 * 2/2003 Kim ..... 15/415.1
7,155,774 B2 * 1/2007 Jung ..... 15/414
2004/0123418 A1 * 7/2004 Jung ..... 15/414
2006/0053585 A1 * 3/2006 Zhang ..... 15/414

* cited by examiner

*Primary Examiner*—David B Thomas
(74) *Attorney, Agent, or Firm*—King & Schickli, PLLC

(57) ABSTRACT

A vacuum cleaner includes a housing carrying a suction generator and a dirt collection vessel. In addition the vacuum cleaner includes a cleaning nozzle including a wand receiver, a tubular wand, a latch releasably securing an end of the wand to the wand receiver and a latch release carried on the wand or the cleaning nozzle. The latch release is characterized by a lever, a cam carried on the lever and a cam guide track. The lever is displaceable between a first or home position and a second or wand release position.

6 Claims, 5 Drawing Sheets

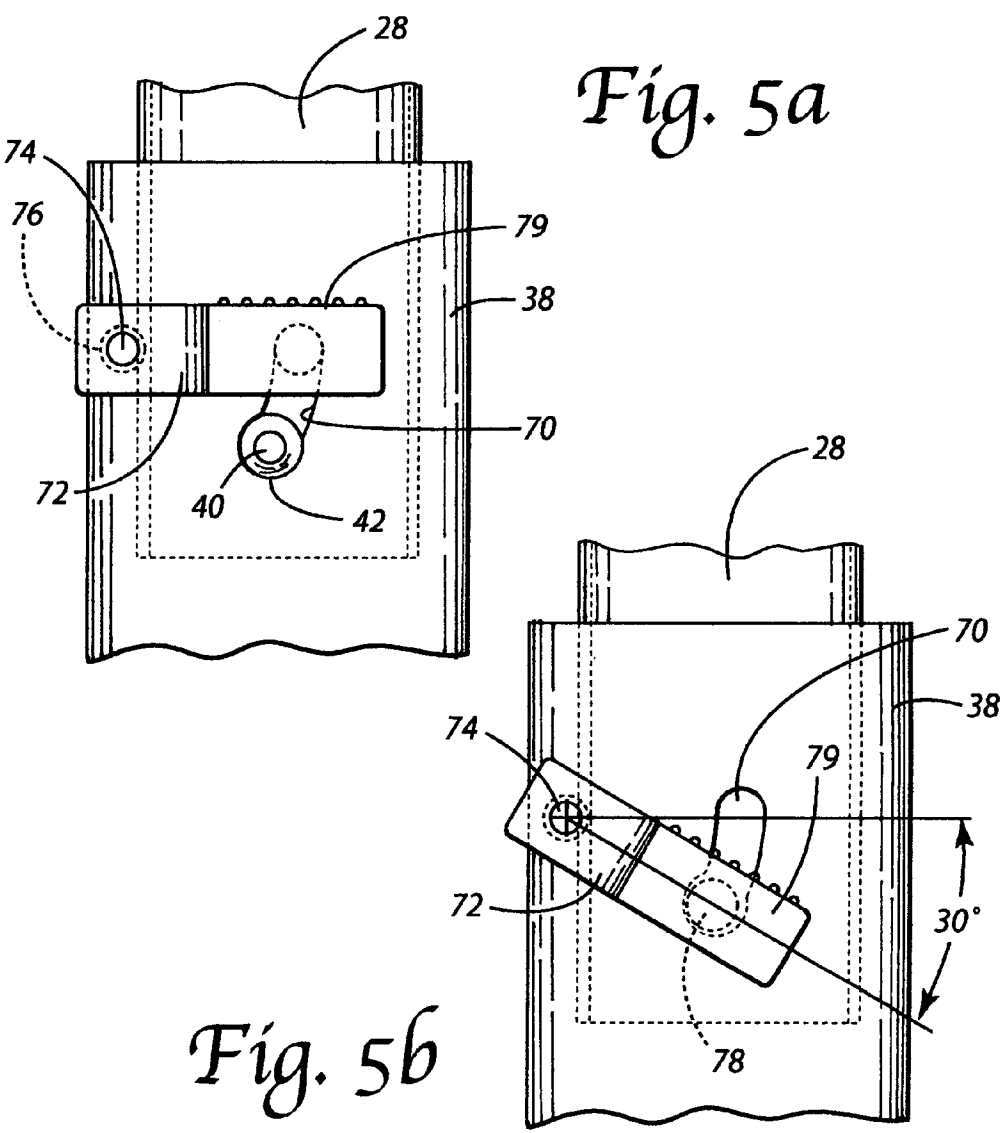
Fig. 5a
Fig. 5b
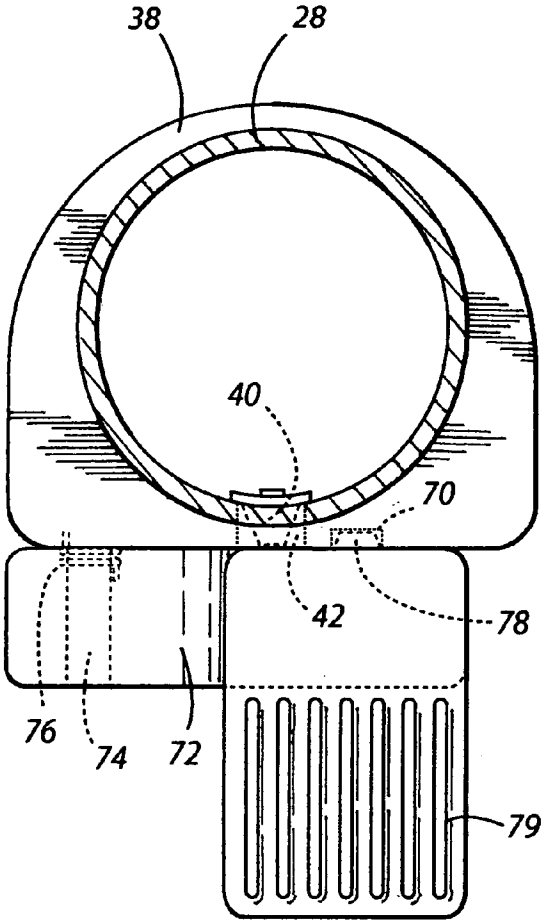
Fig. 4b

VACUUM CLEANER WITH QUICK RELEASE WAND

TECHNICAL FIELD

The present invention relates generally to the floor care appliance field and, more particularly, to a vacuum cleaner incorporating a quick release wand.

BACKGROUND OF THE INVENTION

It is well known in the art to equip both upright and canister vacuum cleaners with a cleaning wand. The wand is of tubular construction and is connected to the suction generator of the vacuum cleaner through a flexible hose. The wand is detached from the main body of the upright vacuum cleaner or a nozzle assembly of the canister vacuum cleaner for purposes of specialty cleaning. Specialty cleaning includes but is in no way limited to tight corners where insufficient clearance exists for cleaning with the upright vacuum cleaner or nozzle assembly. It also includes above floor cleaning applications such as the cleaning of dirt and debris from upholstered furniture, the tops of baseboards, windowsills, draperies or the like.

An important feature of any vacuum cleaner of this type is the ability to quickly and conveniently release the wand for the specialty cleaning applications. The present invention relates to a vacuum cleaner equipped with just such a quick release wand.

SUMMARY OF THE INVENTION

In accordance with the purposes of the present invention as described herein a vacuum cleaner is provided comprising a housing carrying a suction generator and a dirt collection vessel, a cleaning nozzle including a wand receiver, a tubular wand, a latch releasably securing an end of the wand to the wand receiver and a latch release carried on one of the wand and cleaning nozzle. The latch release is characterized by a lever, a cam carried on the lever and a cam guide track. The lever is displaceable between a first position wherein the cam is positioned adjacent a first end of the guide track and a second position wherein the cam is positioned adjacent a second end of the guide track in engagement with the latch whereby the latch is released from a locked position so as to allow the wand to be removed from the wand receiver.

In accordance with one embodiment of the invention the guide track is a straight slot. Additionally, the vacuum cleaner includes a spring for biasing the lever into the first position. Such a spring may comprise a compression spring having a first end engaging the wand receiver and a second end engaging the lever. In this embodiment the lever is captured on the wand receiver so as to allow sliding movement of the cam along the guide track. Further the lever may include a foot pedal portion.

In a second alternative embodiment the guide track is arcuate. In this embodiment the lever is connected to a wand receiver by a pivot pin. A torsion spring is provided for biasing the lever into the first position. The pivot pin defines a pivotal axis provided in a plane substantially parallel to the wand. Further the lever includes a foot pedal portion that may be conveniently engaged with the foot of the operator so as to pivot the lever against the biasing force of the torsion spring through an arc of perhaps 15 to 20 degrees and thereby release the latch so that the wand may be quickly and easily removed from the wand receiver.

In the following description there is shown and described multiple embodiments of this invention, simply by way of illustration of some of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain certain principles of the invention. In the drawings:

FIGS. 4*a* and 4*b* are detailed schematical cross-sectional views illustrating the structure and operation of a second embodiment of the latch release provided on a vacuum cleaner; and FIGS. 5*a* and 5*b* are side elevational views of the second embodiment with FIG. 5*a* corresponding to the view illustrated in FIG. 4*a* and FIG. 5*b* corresponding to the view illustrated in FIG. 4*b*.

Reference will now be made in detail to the present preferred embodiments of the invention, examples of which are illustrated in the accompanying drawings.

DETAILED DESCRIPTION OF THE INVENTION

Figure 1:
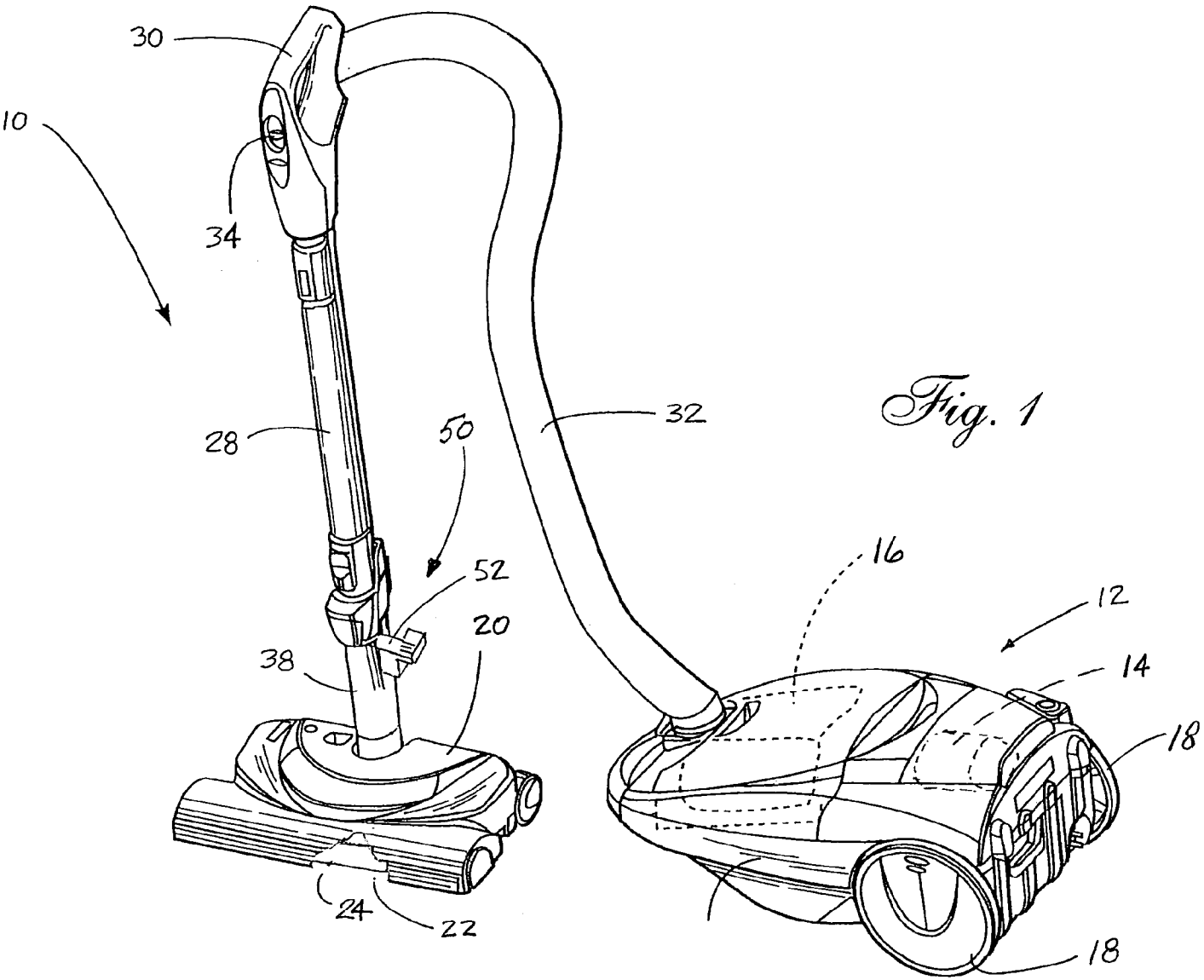
FIG. 1 is a perspective view of a vacuum cleaner of the present invention.

Reference is now made to FIG. 1 generally illustrating a vacuum cleaner 10 of the present invention. As illustrated, the vacuum cleaner 10 includes a housing 12 that carries a suction generator 14 and a dirt collection vessel 16 such as a filter bag or dirt cup. As illustrated the housing 12 is supported on wheels 18 for free movement across the floor.

In addition the vacuum cleaner 10 includes a cleaning nozzle or power head 20. Such a cleaning nozzle may incorporate a suction inlet 22 equipped with a rotary agitator 24 driven by an onboard agitator drive motor (not shown). The cleaning nozzle 20 is connected to the main housing 12 by a wand 28, control handle 30 and flexible hose 32. A control actuator 34 provided on the control handle 30 allows the operator to turn the vacuum cleaner 10 on and off. During normal floor cleaning operation the rotary agitator 24 functions to beat dirt and debris from the nap of an underlying carpet. The suction generator 14 draws an airstream entrained with that dirt and debris through the suction inlet 22, and the tubular wand 28 and the flexible hose 32 into the dirt collection vessel 16. The dirt and debris is stripped from the airstream in the dirt collection vessel 16 and then now relatively clean air is drawn over the suction generator 14 to provide cooling before being exhausted into the environment.

Figure 2:
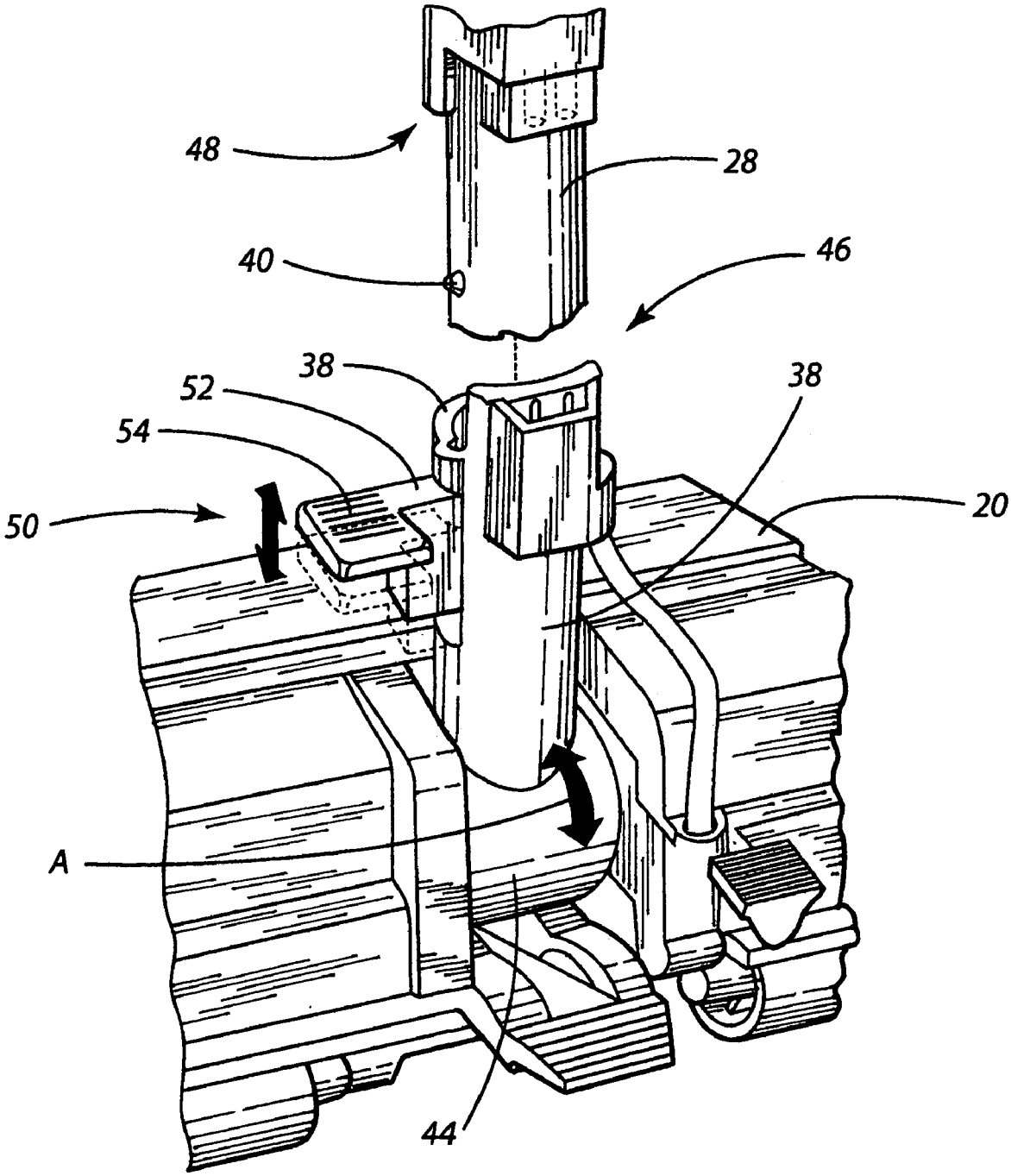
FIG. 2 is a detailed perspective view illustrating the wand, wand receiver and cleaning head of the vacuum cleaner illustrated in FIG. 1.
Figure 3A:
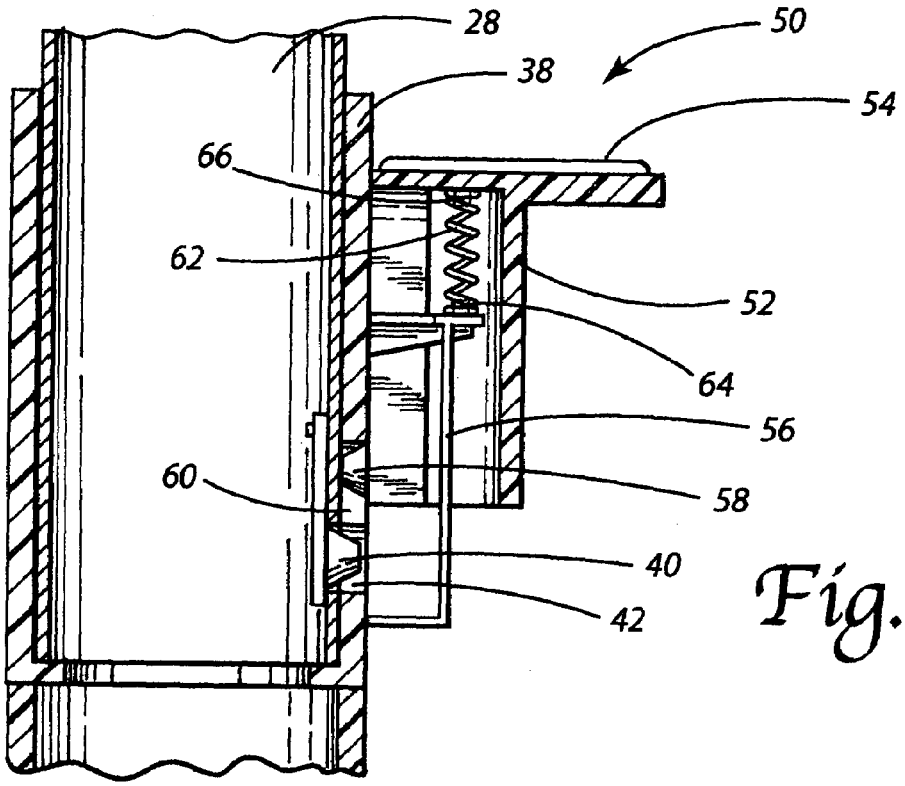
FIGS. 3*a* and 3*b* are detailed, schematical cross-sectional views illustrating the structure and operation of a first embodiment of the latch release provided on the vacuum cleaner.
Figure 3B:
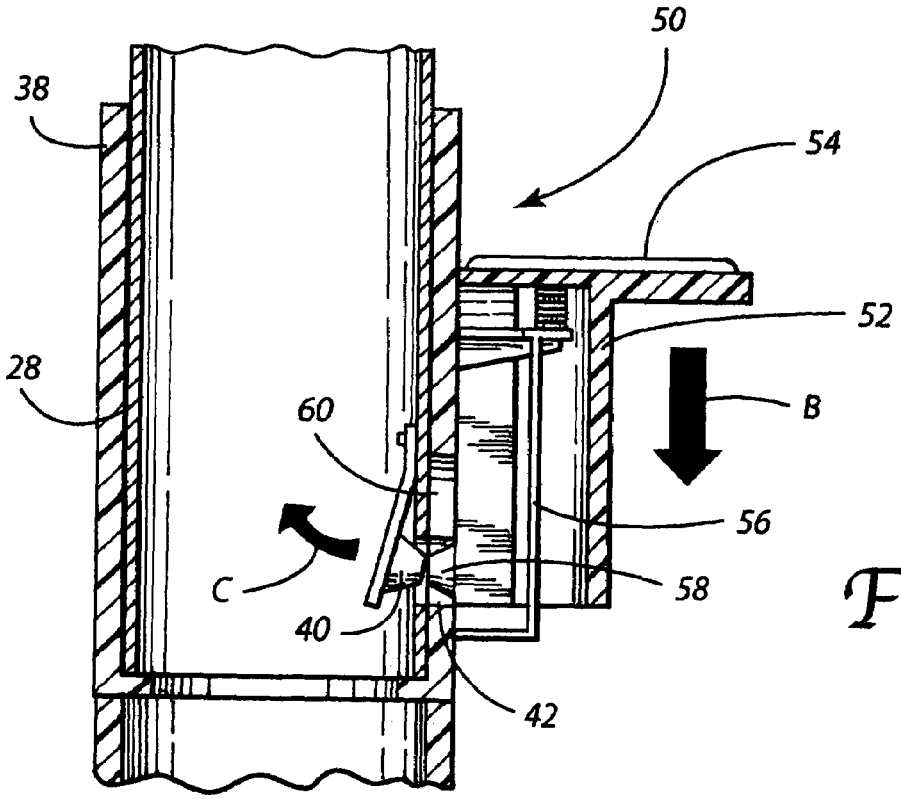

As best illustrated in FIGS. 2, 3*a* and 3*b*, the cleaning nozzle 20 includes a wand receiver 38 that receives and holds an end of the wand 28. More specifically, the wand receiver 38 includes a tubular section for receiving the end of the wand 28. As illustrated in FIG. 3*a* the wand 28 is pressed down into the end of the wand receiver 38. When the wand 28 is fully seated in the receiver 38, the spring loaded latch or detent 40 engages in the locking aperture 42 provided in the wand receiver 38 so as to positively secure the wand in the receiver. Simultaneously, cooperating male and female electrical connectors, generally designated by reference numerals 46 and 48, are secured together to provide power to the agitator drive motor and any light or other electrical accessory carried by the cleaning nozzle 20.

As best illustrated in FIG. 2, the wand receiver 38 also includes a trunnion section 44 providing a pivotal connection (note action arrow A) between the wand receiver and the cleaning nozzle 20. Together, the rigid connection of the wand 28 in the wand receiver 38 by the latch or detent 40 and the trunnion 44 allow the operator to freely manipulate the cleaning nozzle through the control handle 30 during normal vacuum cleaner operation.

At times and for particular specialty cleaning applications, the operator will desire to release the wand 28 from the wand receiver 38. This may be easily accomplished utilizing the latch release, generally designated by reference numeral 50, carried on the wand receiver 38. As best illustrated in FIGS. 3*a* and 3*b*, the latch release 50 comprises a lever 52 including a foot portion 54. The lever 52 is captured for sliding movement on the support 56 secured to the wand receiver 38. A cam 58 is carried on the lever 52. As illustrated in FIGS. 3*a* and 3*b*, the cam 58 is received in and slides along a cam guide track 60 provided in the wall of the wand receiver 38. A compression spring 62 has a first end 64 that engages the support 56 of the wand receiver 38 and a second end 66 that engages the lever 52. The compression spring 62 functions to bias the lever 52 into a first or home position illustrated in FIG. 3*a* wherein the cam 58 is received adjacent a first end of the cam guide track 60.

By depressing the lever 52 in the direction of action arrow B (note FIG. 3*b*), the cam 58 slides along the cam guide track 60 to a second position: that is the locking aperture 42 at the second end of the guide track. In this position the cam 58 engages the latch or detent 40, forcing the latch or detent from the locking aperture 42 (note action arrow C). At this point, the wand 28 may be freely withdrawn from the wand receiver 38 for any desired specialty cleaning operation. After releasing the lever 52, the compression spring 62 biases the lever back to the first or home position illustrated in FIG. 3*a*.

After completing any specialty cleaning application, the wand 28 may be simply and easily returned to the wand receiver 38. More specifically, the wand 28 is aligned with the wand receiving socket of the wand receiver 38 and depressed until fully seated therein. At this point the detent 40 is again biased into the locking aperture 42 thereby completing a rigid connection between the wand and wand receiver 38 as illustrated in FIG. 3*a*.

A second embodiment of the latch release 50 is illustrated in FIGS. 4*a*, 4*b*, 5*a* and 5*b*. In this embodiment the sidewall of the receiver 38 is flat on the side of the lever 72 and the cam guide track 70 is arcuate in shape. In addition, the lever 72 is pivotally mounted to the wand receiver 38 by means of a pivot pin 74. A torsion spring 76 received over the pivot pin 74 functions to bias the lever 72 in the first or home position illustrated in FIGS. 4*a* and 5*a*. In this position, the cam 78 provided on the lever 72 is positioned adjacent a first end of the guide track 70.

Figure 4A:
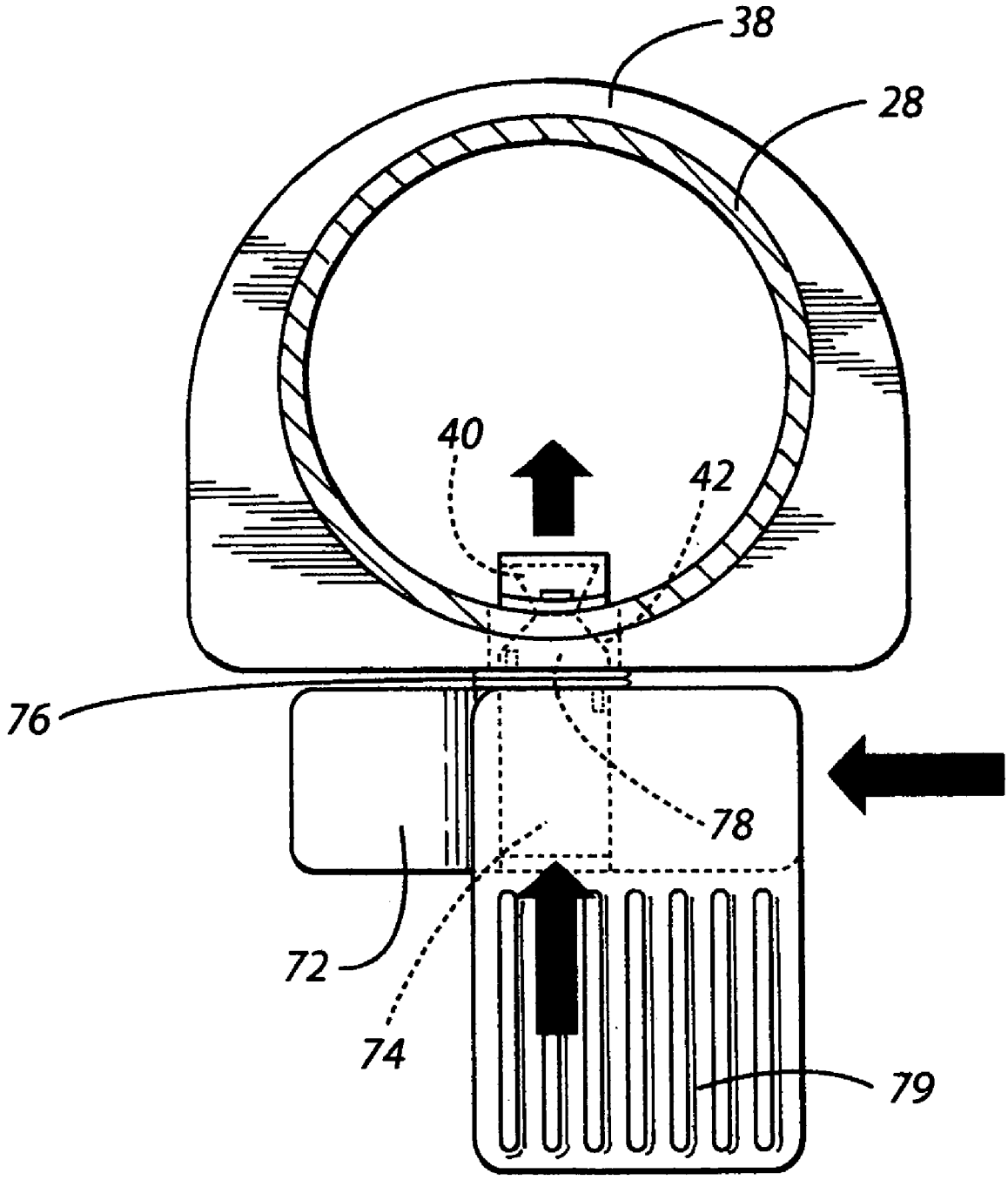

When an operator wishes to remove the wand 28 from the wand receiver 38, the foot portion 79 of the lever 72 is engaged and the lever is pivoted about the pivot pin 74. As this is done the cam 78 provided on the lever 72 moves along the arcuate guide track 70 to the second end thereof at the locking aperture 42. There the cam 78 engages the detent 40 forcing the detent from the locking aperture 42 in the wand receiver 38 (see FIGS. 4*b* and 5*b*). The operator is then free to remove the wand 28 from the wand receiver 38. Upon releasing the lever 72, the torsion spring 76 returns the lever to the home position as illustrated in FIGS. 4*a* and 5*a*.

In summary, numerous benefits result from employing the concepts of the present invention. In either embodiment, it is possible for an operator to quickly and easily release a wand 28 from the wand receiver 38 for purposes of specialty cleaning operations. The sliding action of the lever 52 in the first embodiment illustrated in FIGS. 2, 3*a* and 3*b* and the pivoting action of the lever 72 in the second embodiment illustrated in FIGS. 4*a*, 4*b*, 5*a* and 5*b* are particularly easy to produce when manipulating the lever by engaging the foot portion 54, 79 with the foot or toe.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, the wand 28 may comprise a telescoping wand assembly in order to allow the length of the wand to be adjusted. Similarly, while the cleaning nozzle 20 illustrated incorporates a rotary agitator 24 and agitator drive motor, a simple cleaning head without these features may be provided. Further, while the vacuum cleaner 10 is illustrated as a canister vacuum cleaner, it should be appreciated that the vacuum cleaner may comprise an upright vacuum cleaner equipped with a removable wand. That wand may be attached to the housing of the upright vacuum cleaner at either the nozzle assembly or the canister assembly as desired. Further, while the latch release 50 has been illustrated and described as being carried on the wand receiver 38 or cleaning nozzle 20, it should be appreciated that the latch release may alternatively be carried on the wand if desired.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A vacuum cleaner, comprising:

a housing carrying a suction generator and a dirt collection vessel;

a cleaning nozzle including a wand receiver;

a tubular wand;

a latch releasably securing an end of said wand to said wand receiver; and a latch release carried on one of said wand and said cleaning nozzle;

said latch release being characterized by a lever, a cam carried on said lever and an arcuate cam guide track, said lever being displaceable between a first position wherein said cam is positioned adjacent a first end of said guide track and a second position wherein said cam is positioned adjacent a second end of said guide track in engagement with said latch whereby said latch is released from a locked position so as to allow said wand to be removed from said wand receiver.

2. The vacuum cleaner of claim 1, wherein said lever is connected to said wand receiver by a pivot pin.

3. The vacuum cleaner of claim 2, further including a spring biasing said lever into said first position.

4. The vacuum cleaner of claim 3, wherein said spring is a torsion spring.

5. The vacuum cleaner of claim 4, wherein said pivot pin defines a pivotal axis provided in a plane substantially parallel to said wand.

6. The vacuum cleaner of claim 5, wherein said lever includes a foot pedal portion.

* * * * *